US010313778B2

(12) United States Patent
Ernst et al.

(10) Patent No.: US 10,313,778 B2
(45) Date of Patent: Jun. 4, 2019

(54) METHOD FOR OPERATING AN ELECTROACOUSTIC SYSTEM AND ELECTROACOUSTIC SYSTEM

(71) Applicant: Carl von Ossietzky Universität Oldenburg, Oldenburg (DE)

(72) Inventors: Stephan Ernst, Oldenburg (DE); Marko Hiipakka, Espoo (FI); Birger Kollmeier, Oldenburg (DE); Florian Denk, Oldenburg (DE)

(73) Assignee: Carl von Ossietzky Universität Oldenburg, Oldenburg (DE)

( * ) Notice: Subject to any disclaimer, the term of this patent is extended or adjusted under 35 U.S.C. 154(b) by 0 days.

(21) Appl. No.: 15/561,172

(22) PCT Filed: Mar. 22, 2016

(86) PCT No.: PCT/EP2016/056232
§ 371 (c)(1),
(2) Date: Sep. 25, 2017

(87) PCT Pub. No.: WO2016/150974
PCT Pub. Date: Sep. 29, 2016

(65) Prior Publication Data

US 2018/0084328 A1 Mar. 22, 2018

(30) Foreign Application Priority Data

Mar. 26, 2015 (DE) ..... 10 2015 003 855

(51) Int. Cl.
*H04R 1/10* (2006.01)
*H04R 25/00* (2006.01)

(52) U.S. Cl.
CPC ..... *H04R 1/1041* (2013.01); *H04R 1/1016* (2013.01); *H04R 25/00* (2013.01); *H04R 2460/05* (2013.01)

(58) Field of Classification Search
None
See application file for complete search history.

(56) References Cited

U.S. PATENT DOCUMENTS

2006/0002574 A1 1/2006 Shennib et al.
2009/0097681 A1* 4/2009 Puria ..... H04R 25/405 381/318

(Continued)

FOREIGN PATENT DOCUMENTS

DE 698 37 725 T2 1/2008
WO 2014/070825 A1 5/2014

OTHER PUBLICATIONS

M. Hiipakka, M. Karjalainen and V. Pulkki, "Estimating pressure at eardrum with pressure-velocity measurements from ear canal entrance," Application of Signal Processing to Audio and Acoustics, 2009. WASPAA '09. IEEE Workshop on., 2009.

(Continued)

*Primary Examiner* — Curtis A Kuntz
*Assistant Examiner* — Kenny H Truong
(74) *Attorney, Agent, or Firm* — McGlew and Tuttle, P.C.

(57) ABSTRACT

A method for operating an electro-acoustic system (11) arranges an electro-acoustic device (10), for occluding an ear canal on an ear and uses a signal processing device (16) for processing a signal incoming at the device (10). A correction unit (17) of the signal processing device (16) modifies the signal incoming at the device (10). To reduce, to avoid or to compensate for an interfering or undesired change in a perception of ambient noises during the use of an electro-acoustic device occluding the ear canal, with the correction unit (17), a signal outgoing from the device (10) is generated in order to achieve acoustic transparency, in which, on the basis of the outgoing signal, a received signal is generated at the eardrum which is adapted so as to (Continued)

correspond to a free-ear received signal at the eardrum in the case of a free ear canal without the device (10).

20 Claims, 4 Drawing Sheets

(56) References Cited

U.S. PATENT DOCUMENTS

| | | | | |
|---|---|---|---|---|
| 2010/0266136 | A1* | 10/2010 | Kelloniemi ..... | G10K 11/178<br>381/71.6 |
| 2010/0329481 | A1 | 12/2010 | Fukuda et al. | |
| 2014/0126734 | A1* | 5/2014 | Gauger, Jr. ..... | H04R 3/002<br>381/71.6 |
| 2014/0321657 | A1 | 10/2014 | Stirnemann | |

OTHER PUBLICATIONS

M. Hiipakka, T. Kinnari and V. Pulkki, "Estimating head-related transfer functions of human subjects from pressure-relocity measurements," The Journal of the Acoustical Society of America, 2012.

* cited by examiner

METHOD FOR OPERATING AN ELECTROACOUSTIC SYSTEM AND ELECTROACOUSTIC SYSTEM

CROSS REFERENCE TO RELATED APPLICATIONS

This application is a United States National Phase Application of International Application PCT/EP2016/056232, filed Mar. 22, 2016, and claims the benefit of priority under 35 U.S.C. § 119 of German Application 10 2015 003 855.9, filed Mar. 26, 2015, the entire contents of which are incorporated herein by reference.

FIELD OF THE INVENTION

The present invention pertains to a method for operating an electroacoustic system, in which an electroacoustic device for at least partially occluding an ear canal is arranged at least partially on an ear, in which a signal processing device is used to process a signal incoming to the device, and in which at least one correction unit of the signal processing device is intended and/or used to modify the signal incoming to the device. Furthermore, the present invention pertains to an electroacoustic system, which is operated according to such a method.

BACKGROUND OF THE INVENTION

Such a method and such an electroacoustic system are known from US 2014/0321657 A1. According to this, an incoming acoustic signal can be modified taking into account the acoustic properties of the ear canal in an area between the device at least partially occluding the ear canal and the eardrum.

Using electroacoustic systems and/or an electroacoustic device that at least partially or completely occlude, fill up, shut and/or close an ear and/or an ear canal, for example, in the area of consumer electronics and/or hearing aids is known. In this case, it is disadvantageous that the occlusion of the ear canal causes a change in the perception of ambient noises. This changed perception of ambient noises, and especially natural ambient noises, may comprise a muffling, a spectral modification, a change in the color tone, a change in the sound spectrum and/or a change in spatial perception. It is especially disadvantageous that ambient noises are not perceived and/or are perceived as unnatural in case of an ear canal at least partially occluded by means of the electroacoustic device. This may lead to a danger to the person using the electroacoustic device, especially in traffic. In addition, the wearing and/or use of the electroacoustic device may be felt to be uncomfortable.

SUMMARY OF THE INVENTION

A basic object of the present invention is to further develop a method and electroacoustic system of the type mentioned in the introduction such that an interfering and/or undesired change in the perception of ambient noises during the use of an electroacoustic device at least partially occluding the ear canal is reduced, avoided and/or at least partially compensated.

The basic object of the present invention is accomplished by means of a method and by means of an electroacoustic system of the type mentioned in the introduction, wherein a signal outgoing from the device by means of the at least one correction unit is generated to achieve acoustic transparency, in which, on the basis of the outgoing signal, a received signal is generated at the eardrum, which is adapted to correspond to a free-ear received signal at the eardrum in case of a free ear canal without the device.

It is advantageous here that ambient noises can be perceived in sufficient quality despite an at least partial occluding of the ear canal. In particular, the method and/or the electroacoustic system makes possible a checking, control and/or manipulation of the received signals, preferably of a frequency response, at the eardrum. The electroacoustic system can be operated in an acoustic transparency mode as a result of this. The perception of ambient noises of a person using the electroacoustic system is preferably not disturbed or changed because of the acoustic transparency, or is disturbed or changed slightly at most and/or to a non-disturbing extent. The person using the electroacoustic system preferably experiences a perception of noises, especially approximately as with a free ear canal. Thus, the method and/or the electroacoustic system makes possible a pleasant, especially natural, perception of ambient noises in case of a partially and/or completely occluded ear canal. The electroacoustic system here may make possible a plurality of additional functions, for example, in conjunction with a consumer electronic device, with a hearing protection device, with a hearing aid and/or with a communication device, in particular a mobile phone and/or a smartphone. In particular, a hearing aid may be additionally provided, preferably when needed. The received signal generated at the eardrum may be amplified and/or muffled in comparison to the signal incoming to the device.

Within the framework of the present application, acoustic transparency is preferably configured as a perceptive acoustic transparency. In particular, a perceptive and/or acoustic transparency means that there is no audible distinction from a free-ear signal or free-ear received signal. A perceptive and/or acoustic transparency can thus be achieved, without having to achieve an absolute physical agreement of the received signal generated at the eardrum with a free-ear received signal in case of a free ear canal without the device. It is preferably sufficient when a person using the device has the perception that the received signal generated with the device agrees, in terms of perception, with the free-ear received signal in case of a free ear canal without the device.

According to another embodiment, the correction unit has a first correction filter and a second correction filter. The first correction filter of the signal processing device may be intended and/or used to achieve acoustic transparency. The second correction filter of the signal processing device is preferably intended and/or used to modify the especially acoustic signal outgoing from the device. In particular, the acoustic properties of an ear canal section from the device to an eardrum of the ear are taken into account by means of the second correction filter. The first correction filter and/or the second correction filter may be configured as especially digital, electrical circuits. The correction unit, the first correction filter and/or the second correction filter may have at least one analog-to-digital converter and/or at least one digital-to-analog converter.

A first correction filter of the correction unit is preferably arranged upstream of a second correction filter of the correction unit. In particular, the incoming signal is first modified by means of the first correction filter to achieve acoustic transparency. The changed incoming and/or received signal is subsequently modified by means of the second correction filter to filter out transmission effects in the area from the device to the eardrum because of the at least partial occlusion of the ear canal by means of the device. A received signal, which corresponds to the free-ear received signal in case of a free ear canal without the device, is generated by means of the especially acoustic signal outgoing from the device. Thus, an interfering effect of the device at least partially occluding the ear canal on the perception of ambient noises can be reduced and/or compensated. In particular, a received signal, which is adapted to correspond and/or corresponds to a free-ear received signal in this area of the ear canal section in case of a free ear canal without the device, is generated to achieve acoustic transparency on the basis of the outgoing signal in the area of the ear canal section from the device to the eardrum.

According to a variant, the incoming, especially acoustic, signal is fed as an incoming electrical signal to the signal processing device by means of an external sound receiver associated with the device and directed away from the eardrum and outwards. At least one additional, external acoustic and/or electrical signal is preferably fed to the signal processing device, especially by means of an additional external sound receiver and/or a direct wired connection to an additional external signal source. In particular, the external sound receiver and/or the additional external sound receiver is each configured as a microphone. The additional external signal may likewise be modified by means of the correction unit.

A negative feedback loop can especially be achieved by means of the electroacoustic system. The external sound receiver and the additional external sound receiver are preferably used to achieve the negative feedback loop.

According to another embodiment, a calibration is carried out before using the electroacoustic system. A first correction filter and/or a second correction filter is especially determined within the framework of the calibration. The calibration is preferably carried out after each use of the device for at least partially occluding the ear canal. The calibration is especially preferably carried out by means of an external sound source and/or a calibration control unit. As an alternative, a starting calibration may first be carried out to determine the first correction filter and the second correction filter, especially by means of an external sound source. After the starting calibration has been carried out and a new use of the device for at least partially occluding the ear canal, only a single calibration filter, in particular the first correction filter or the second correction filter, is recalibrated within the framework of a partial calibration. A headphone, which is placed onto an auricle with an inserted electroacoustic device, may be used as an external sound source for calibration. The use of a signal hitting the ear from outside is especially advantageous for detecting the spatial resolution of an incoming signal. The calibration control unit may be in the device, in an earpiece, a computer and/or smartphone. The calibration control unit especially has a processor. The calibration control unit may be connected to the electroacoustic device by means of a cable, a wireless connection, a near field communication and/or Bluetooth.

An individual calibration is preferably carried out for the respective person using the device and/or after each use of the device in the ear canal. A calibration and/or setting of the first and/or second correction filter is especially carried out during the current operation. A readjustment can be carried out as a result of this. A readjustment is preferably carried out if at least one predefined triggering parameter is present. For example, a readjustment may be carried out at predefined times or at predefined time intervals. As an alternative or in addition, a readjustment can be initialized when at least one predefined and monitored triggering parameter is reached, fallen below or exceeded.

The correction unit, first correction filter and/or second correction filter are especially recalibrated and/or repositioned in the current operation. A continuous and/or intermittent calibration can thus be carried out especially in conjunction with a starting and/or first calibration.

A first correction filter of the correction unit is preferably determined on the basis of a first model and/or a second correction filter of the correction unit is determined on the basis of a second model. The first model and/or the second model is preferably based on the Thevenin equivalent and/or on the Norton equivalent. These models are tried and tested and make possible a sufficiently accurate estimation of the relevant parameters.

According to a variant, a total pressure $P_{tot}$ of an external acoustic signal within the ear canal at least partially occluded by the device is composed of two parts to determine a first correction filter A of the correction unit. A first part of the total pressure $P_{tot}$ is preferably a passage pressure $P_{HT}$ that is measured by means of an internal sound receiver, which is associated with the device and faces an eardrum of the ear. The internal sound receiver maybe configured as a microphone. The passage pressure $P_{HT}$ is especially a sound pressure of an external acoustic signal after the passage through the ear canal at least partially occluded by the device. A second part of the total pressure $P_{tot}$ is preferably an outgoing pressure $P_{EP}$ measured by means of a sound generator, which is associated with the device and faces the eardrum. The sound generator may be configured as a loudspeaker and/or receiver. At least one other and/or additional sound generator may be provided. The at least one additional sound generator may be arranged at an end of the device facing the eardrum or at an end of the device facing away from the eardrum.

A pressure is preferably defined as a pressure frequency within the scope of the present invention. In particular, a pressure frequency response is obtained at a sound receiver and/or at an eardrum on the basis of a pressure frequency of a signal source, a noise source and/or a sound generator.

According to another embodiment, to determine a first correction filter A of the correction unit, a total pressure $P_{tot}$ of an external acoustic signal within the ear canal at least partially occluded by the device is compared with a target pressure $P_{T,E}$ to be expected. The first correction filter A is preferably determined with the following equation, taking into consideration a passage pressure $P_{HT}$ measured by means of an internal sound receiver, which is associated with the device and faces an eardrum of the ear:

$$A = \frac{P_{T,E} - P_{HT}}{P_{tot} - P_{HT}}.$$

In particular, after a first determination of a first correction filter A of the correction unit, especially within the framework of a calibration, a fine adjustment of the first correction filter A is carried out. At least one predefined calibration signal and/or a predefined noise is preferably used. The calibration signal may be configured as white noise. In particular, a pressure $P_E$ measured by means of an internal sound receiver, which is associated with the device and faces an eardrum of the ear, is compared with a target pressure $P_{T,E}$ during the fine adjustment. The first correction filter A in this case is iteratively adapted until a predefined convergence criterion is reached in case of a deviation of the measured pressure $P_E$ from the target pressure $P_{T,E}$.

To determine a first correction filter A of the correction unit, a pressure $P_E$ measured by means of an internal sound receiver, which is associated with the device and is facing an eardrum of the ear, is preferably compared with a target pressure $P_{T,E}$ to be expected at the internal sound receiver, and the target pressure $P_{T,E}$ to be expected at the internal sound receiver is estimated to be a pressure at the location of the internal sound receiver in case of a free ear canal without the device.

The target pressure $P_{T,E}$ to be expected at the internal sound receiver in case of a free ear canal can be estimated by means of an electroacoustic model, in particular with a Thevenin pressure source model and/or a source impedance model. The target pressure $P_{T,E}$ to be expected at the internal sound receiver is preferably estimated by means of a source pressure $P_S$, an ear canal impedance $Z_L$ and a radiation impedance $Z_{RAD}$ especially with the following equation:

$$P_{T,E} = P_S \frac{Z_L}{Z_L + Z_{RAD}}$$

According to a variant, to determine a second correction filter B of the correction unit by means of an internal sound receiver, which is associated with the device and is facing an eardrum of the ear, an estimation of the acoustic received signal at the eardrum is carried out. An identical frequency response and/or an identical pressure at the internal sound receiver and at the eardrum is especially assumed for the estimation. The pressure at the eardrum $P_D$ is preferably estimated by means of the pressure $P_E$ which is measured at the internal sound receiver by using an electroacoustic model of the ear canal.

A pressure at the eardrum $P_D$ is preferably determined by means of a pressure $P_E$ measured at the internal sound receiver and by means of the correction filter B with the following equation:

$$P_D = P_E B.$$

Thus, the second correction filter B can be determined with knowledge of the pressure at the eardrum $P_D$ and the pressure $P_E$ measured at the internal sound receiver.

The electroacoustic system comprising the electroacoustic device for at least partially occluding an ear canal, especially for carrying out the method according to the present invention, preferably has the signal processing device to process a signal incoming to the device. Here, the signal processing device has at least one correction unit to modify the signal incoming to the device. Furthermore, the correction unit is used to provide and/or generate a signal outgoing from the device. The correction unit has a first correction filter and a second correction filter, wherein the first correction filter of the signal processing device is configured to achieve acoustic transparency, in which, on the basis of the outgoing signal, a received signal can be generated at the eardrum, which is adapted to correspond to a free-ear received signal at the eardrum in case of a free ear canal without the device. The second correction filter of the signal processing device is preferably configured to modify the especially acoustic signal outgoing from the device.

The use of a method according to the present invention and/or an electroacoustic system according to the present invention, especially in connection with a hearing protection device, with an in-ear headphone and/or a hearing aid, is especially advantageous. The method and/or the electroacoustic system according to the present invention can be used in conjunction with a consumer electronic device and/or a communication device, especially with a mobile phone and/or with a smartphone. In particular, the method and/or the electroacoustic system is especially integrated in an existing system and/or an existing device, for example, in a hearing aid, a behind-the-ear device and/or a communication device. An external and/or additional, especially acoustic, signal can be mixed with an ambient signal of an ambient noise. In particular, the mixing is carried out after the application of the first correction filter to the incoming signal and/or to the ambient signal.

The signal processing device may be integrated in an in-ear device, a behind-the-hear device, a computer and/or a communication device, especially in a mobile phone and/or smartphone. The internal sound receiver, the external sound receiver and/or the sound generator are preferably connected by means of a wire to an in-ear device, a behind-the-ear device, a computer and/or a communication device, especially in a mobile phone and/or smartphone.

The acoustic transparency can make possible a perception of ambient noises that is at least largely familiar for a person and/or a spatial hearing in case of a partially occluded ear canal.

The electroacoustic system, the correction unit, the first correction filter and/or second correction filter are configured according to another embodiment to attenuate and/or suppress a sound radiation outwards, especially away from the person using the device and/or from the eardrum.

The electroacoustic device may have a venting device. The venting device may be configured as a venting channel in order to make possible an equalization of pressure in case of a device used in an ear canal. The wearing comfort can be further improved as a result of this. The device and/or an earpiece may comprise an air-permeable material. An internal sound receiver, an external sound receiver and/or a sound generator may be arranged at least partially or completely within the venting device.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
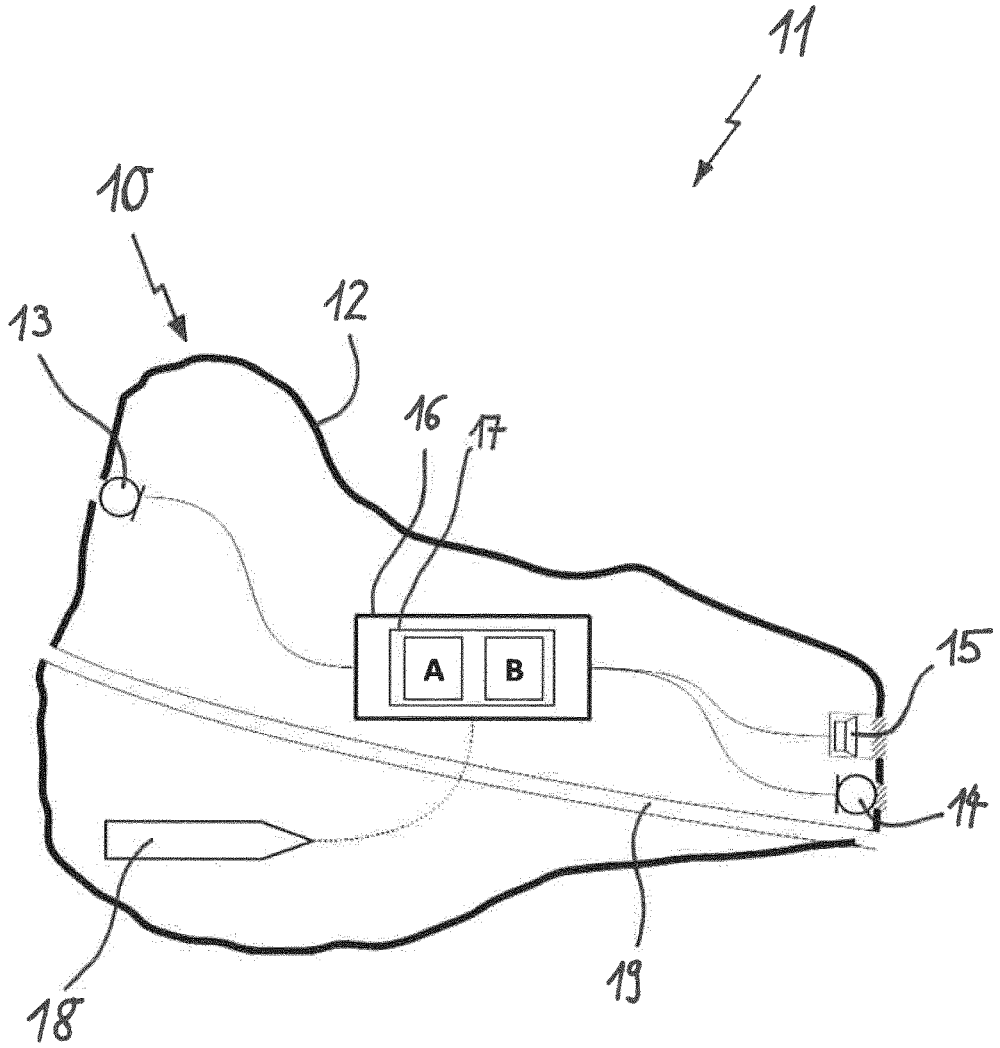
FIG. 1 is a schematic view of an electroacoustic device for an electroacoustic system according to the present invention.

Referring to the drawings, FIG. 1 shows a schematic view of an electroacoustic device 10 for an electroacoustic system 11 according to the present invention. The device 10 has an earpiece 12. The earpiece 12 is adapted, with respect to its shape, to an individual ear canal of a person, not shown in detail here, in this exemplary embodiment. As an alternative, at least one external coating of the earpiece 12 may have an elastic configuration, as a result of which at least a partial adaptation of the surface of the earpiece 12 to the shape of an ear canal is made possible. The earpiece 12 may be arranged in an inner auricle shell and/or an ear canal entrance. The ear canal is at least partially, i.e., partially or completely, occluded by means of the earpiece 12.

The device 10 has an external sound generator 13. The external sound generator 13 is configured as an external microphone in this exemplary embodiment. When the earpiece 12 is used in an ear and/or an ear canal, the external sound generator 13 is directed away from an eardrum, which is not shown in detail here. The external sound generator 13 is directed outwards to receive an incoming signal, namely from acoustic ambient noises. The external sound generator 13 is arranged here, for example, on the surface of the earpiece 12. The position of the external sound generator 13 makes it possible for the incoming signal to contain all spatial monaural information. Incoming acoustic signals are converted into electrical signals by means of the external sound generator 13.

Furthermore, the device 10 has an internal sound generator 14. In this exemplary embodiment, the internal sound receiver 14 is configured as an inner microphone. When the earpiece 12 is used in an ear and/or in an ear canal, the internal sound receiver 14 is facing an eardrum, which is not shown in detail here. The internal sound receiver 14 is directed inwards to detect a sound field in an ear canal section from the device 10 or from the earpiece 12 to the eardrum. The internal sound receiver 14 is arranged, for example, on the surface of the earpiece 12 here. Incoming acoustic signals are then converted into electrical signals by means of the internal sound receiver 14.

The device 10 has a sound generator 15. The sound generator 15 is arranged in the area of the internal sound receiver 14. Furthermore, the sound generator 15 faces an eardrum, which is not shown in detail here, when the earpiece 12 is used in an ear and/or in an ear canal. The sound generator 15 is arranged, for example, on the surface of the earpiece 12 here. The sound generator 15 is directed inwards to radiate the outgoing signal in the ear canal section between the device 10 or the earpiece 12 and the eardrum. The sound generator 15 is configured to convert an electrical signal into an acoustic signal.

The device 10 has a signal processing device 16. The external sound receiver 13, the internal sound receiver 14 and the sound generator 15 are each connected to the signal processing device 16 by means of a wire. The signal processing device 16 is integrated into the earpiece 12 in this exemplary embodiment. As an alternative, the signal processing device 16 may also be arranged outside of the earpiece 12, for example, in a housing for arranging behind an ear or in an auricle. Here, the signal processing device 16 is configured, for example, as a digital signal processing device 16. The signal processing device 16 has analog-digital converters and digital-analog converters, which are connected to electroacoustic sound converters, especially to the external sound receiver 13, to the internal sound receiver 14 and to the sound generator 15. Calculations, modifications and/or corrections in relation to a signal incoming to the external sound receiver 13 and a signal outgoing from the sound generator 15 are carried out by means of the signal processing device 16.

The signal processing device 16 has a correction unit 17. A signal incoming to the device 10 or to the external sound receiver 13 is corrected and/or modified by means of the correction unit 17 in order to generate a signal outgoing from the device 10 or from the sound generator 15. The correction unit 17 has a first correction filter A and a second correction filter B.

In this exemplary embodiment the signal processing device 16 is connected to an additional external signal source 18 by means of a wire. An additional external, especially acoustic, signal can be fed to the signal processing device 16 by means of the additional signal source 18. The additional signal source may be configured as a consumer electronic unit, as a music source and/or as a communication device.

The device 10 or the earpiece 12 has a venting device 19. The venting device 19 is configured as a venting channel in this exemplary embodiment. The venting device 19 makes possible a pressure equalization in case of a device 10 used in an ear canal. An air volume of an ear canal section between the earpiece 12 and the eardrum is connected to the surrounding area outside of the ear canal or ear by means of the venting device 19.

The internal sound receiver 14 makes possible an estimation of a received signal and/or an acoustic signal at the eardrum, especially of a frequency response at the eardrum on the basis of any noise source in case of an ear canal at least partially occluded by the device 10 or the earpiece 12. This estimation can be carried out by the mechanical-acoustic properties of the device 10 being assumed such that the frequency response at the position of the internal sound receiver 14 and the eardrum are identical. In this exemplary embodiment, the pressure at the eardrum is estimated by means of the pressure measured at the position of the internal sound receiver 14 using an electroacoustic model of the ear canal P.

Figure 2:
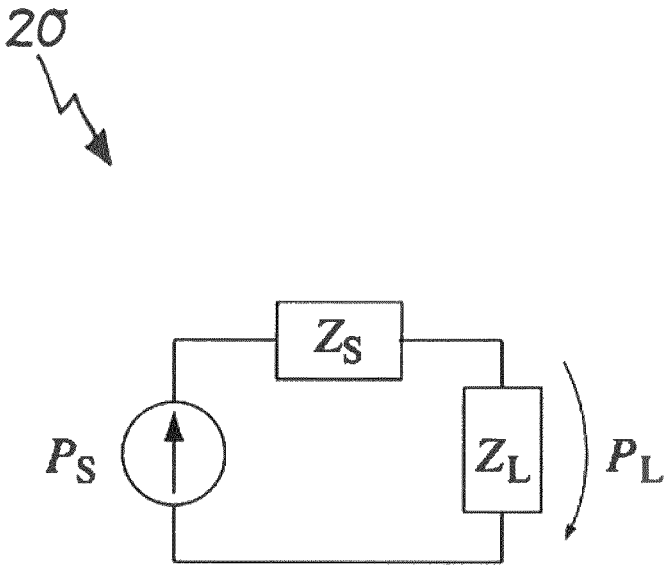
FIG. 2 is a schematic view of an electroacoustic model of the electroacoustic device according to FIG. 1.

FIG. 2 shows a schematic view of an electroacoustic model 20 of the electroacoustic device 10 according to FIG. 1. The device 10 or the earpiece 12 according to FIG. 1 is modeled as a Norton- and/or Thevenin-equivalent electroacoustic velocity and/or pressure model, which is connected to the ear canal impedance according to the view in FIG. 2.

The source parameters are applied to an electroacoustic circuit model, which has a voltage source for the pressure or a current source for the velocity, an inner source impedance, the ear canal as a two-port network and the eardrum as the terminating impedance of the circuit. The source terms $P_S$ for the pressure, $Q_S$ for the velocity and $Z_S$ for the impedance can be determined by means of measurements of the pulse responses, which are induced by the sources, when these are connected to various loads of known theoretical impedances. Therefore, these sources are assumed to be known and are part of the electroacoustic ear canal model P, which is dependent on the individual configuration of the device 10. The abbreviation $P_L$ in FIG. 2 denotes the load pressure and the abbreviation $Z_L$ denotes the load impedance.

The load impedance $Z_L$ is determined with the following formula by means of the pressure $P_E$ measured at the position of the internal sound receiver 14 and using the electroacoustic circuit model according to FIG. 2

$$Z_L = \frac{Z_S P_E}{P_S - P_E}$$

When the source impedance $Z_S$, the load impedance of the ear canal $Z_L$, especially in an area from the device 10 or the earpiece 12 to the eardrum, and the pressure $P_E$ present in the interior of the ear canal and/or a pressure frequency response are known, the particle velocity $U_E$ at the position of the internal sound receiver 14 is determined using the load impedance $Z_L$ according to $$U_E = \frac{P_E}{Z_L}$$

and/or using the source impedance $Z_S$ according to $$U_E = \frac{P_S - P_E}{Z_S}$$

The relationship of a pressure at the eardrum $P_D$ to the pressure $P_E$ at the position of the internal sound receiver 14 is given according to estimation methods based on the energy density, as it is described, for example, in the following document:

M. Hiipakka, M. Karjalainen and V. Pulkki, "*Estimating pressure at eardrum with pressure-velocity measurements from ear canal entrance*," Application of Signal Processing to Audio and Acoustics, 2009. WASPAA '09. IEEE Workshop on., 2009.

The pressure $P_E$ measured at the position of the internal sound receiver 14 and the estimated particle velocity $U_E$ are used to obtain the following estimation:

$$P_D = \sqrt{|P_E|^2 + |U_E \rho c|^2}$$

ρ is the air density and c is the sound velocity here.

The ratio of $P_E$ to $P_D$ is converted into the linear filter B, as a result of which the following equation is obtained:

$$P_D = P_{EB}.$$

The acoustic properties of the ear canal, especially in an area between the device 10 at least partially occluding the ear canal and the end of the earpiece 12 facing the eardrum, are taken into account by means of the filter B during the modification or correction by means of the signal processing device 16 and the correction unit 17, respectively.

Figure 3:
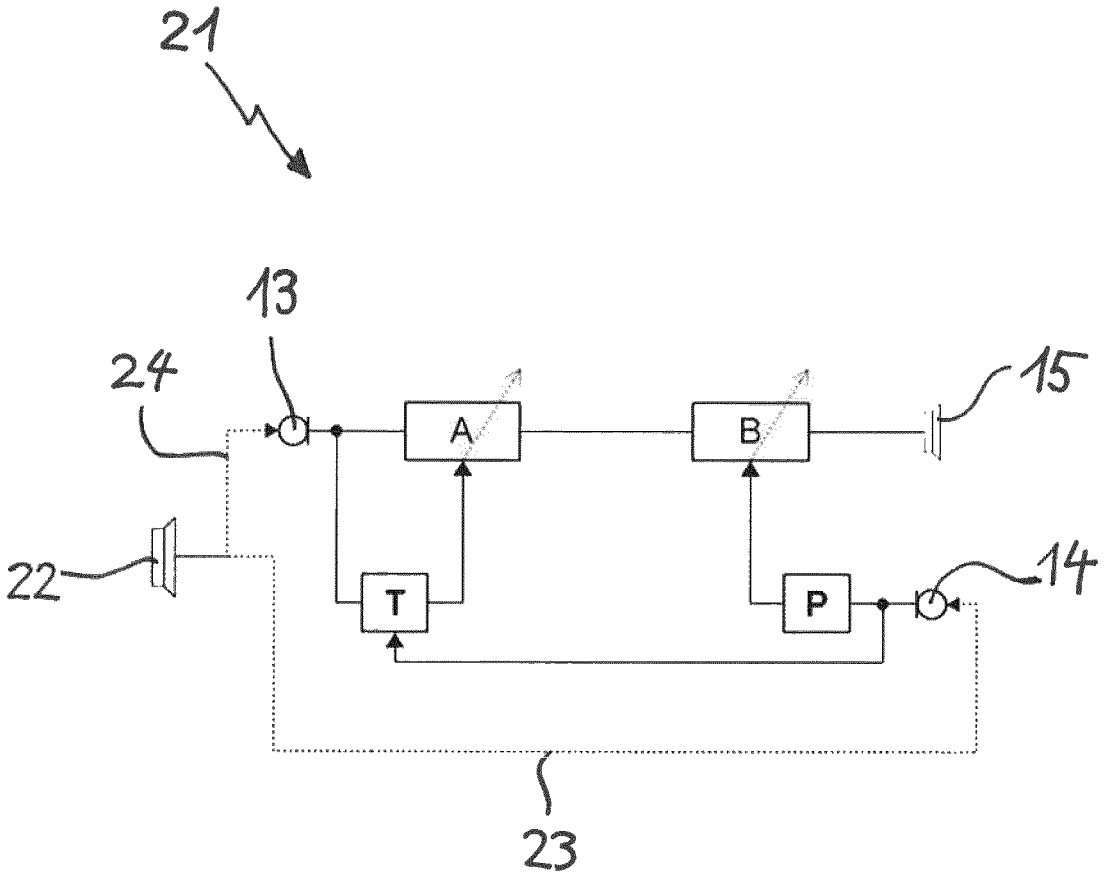
FIG. 3 is a schematic view of a logic circuit of a signal processing device with the electroacoustic device according to FIG. 1 during a calibration.

FIG. 3 shows a schematic view of a logic circuit 21 of a signal processing device with the electroacoustic device 10 according to FIG. 1 during a calibration.

The electroacoustic system 11, the device 10 or the earpiece 12 can be calibrated in situ, i.e., in case of an at least partially occluded ear canal. The goal of the calibration is to obtain a predefined pressure and/or a predefined frequency response at the eardrum using a calibration routine. The filter A is intended for this. A signal outgoing from the device 10 or from the sound generator 15 can be generated by means of the filter A by modification of the incoming signal, which signal generates a target pressure and/or a target frequency response at the position of the internal sound receiver 14.

Thus, the pressure $P_E$ at the position of the internal sound receiver 14 corresponds to the target pressure $P_{T,E}$ at the position of the internal sound receiver 14:

$$P_E = P_{T,E}$$

The pressure $P_E$ or target pressure $P_{T,E}$ at the position of the internal sound receiver 14 is obtained on the basis of an ambient noise signal from a noise source 22. The noise source 22 is outside of the ear and causes common ambient noises.

As is shown according to FIG. 3, the acoustic signal outgoing from the noise source 22 within the ear canal and in case of an ear canal at least partially occluded by means of the device 10 or the earpiece 12 is split into two partial signals 23, 24.

The first partial signal 23 is a passage signal. A pressure frequency response and/or a passage pressure $P_{HT}$, which is measured at the position of the internal sound receiver 14, are associated with the first partial signal 23. The second partial signal 24 is a device-released signal. The second partial signal 24 is generated and released by means of the sound generator 15 from the earpiece 12 in the direction of the eardrum. The second partial signal 24 is obtained by the signal incoming to the external sound receiver 13, which is modified by means of the filtering by means of the first filter A and the second filter B and is subsequently released by means of the sound generator 15. An outgoing pressure frequency and/or an outgoing pressure $P_{EP}$ is associated with the second partial signal 24.

The passage pressure $P_{HT}$ and the outgoing pressure $P_{EE}$ are measured for the calibration by means of the sound receivers 13, 14 using the noise source 22, which is configured as a headphone in this exemplary embodiment, when the filters A and B are not applied. However, since the outgoing pressure $P_{EP}$ cannot be measured independently of the passage pressure $P_{HT}$, a total frequency response and/or a total pressure $P_{tot}$ is introduced:

$$P_{tot} = P_{EP} + P_{HT}.$$

The total pressure $P_{tot}$ is compared to the target pressure $P_{T,E}$, taking the correction filter A into consideration:

$$P_{T,E} = P_{HT} + P_{EP}A = P_{HT} + (P_{tot} - P_{HT})A.$$

After the first determination described above, a first correction filter A is thus calculated by means of the measured frequency responses and/or pressures $P_{T,E}$, $P_{HT}$ and $P_{tot}$ as follows:

$$A = \frac{P_{T,E} - P_{HT}}{P_{tot} - P_{HT}}$$

This first correction filter A is determined within the framework of a first calibration.

A fine adjustment of the correction filter A can then be carried out. A predefined calibration signal is used to adapt the actual frequency response and/or the pressure $P_E$ at the internal sound receiver 14 to the target pressure $P_{T,E}$. In this exemplary embodiment, the calibration signal is configured as white noise. The calibration signal is released by the noise source 22. The frequency response and/or the pressure $P_E$ are measured by means of the internal sound receiver 14. The correction filter A is adapted correspondingly on the basis of a deviation of the measured pressure $P_E$ from the target pressure $P_{T,E}$. The first correction filter A is adapted iteratively in case of a deviation of the measured pressure $P_E$ from the target pressure $P_{T,E}$ until a predefined convergence criterion is reached.

The target pressure $P_{T,E}$ at the position of the internal sound receiver 14 must be known for the determination of the correction filter A or for achieving the acoustic transparency. Furthermore, the generated frequency response and/or the pressure $P_D$ at the eardrum for a free ear canal and an at least partially occluded ear canal with an active and calibrated device 10 must be identical. The pressure $P_D$ at the eardrum is consequently equated with the target pressure $P_{T,D}$ at the eardrum:

$$P_D = P_{T,D}.$$

A target model T is introduced in order to provide the frequency response and/or the pressure at the eardrum as an individual estimation for each person using the device 10.

In this case, however, the frequency response and/or the target pressure $P_{T,D}$ at the eardrum are not determined or estimated. Instead, the target frequency response and/or the target pressure $P_{T,E}$ at the position of the internal sound receiver 14 in case of a free ear canal are estimated.

An electroacoustic circuit model, which has a Thevenin pressure source model $P_S$ and a source impedance model $Z_S$, is used for this. The source pressure $P_S$ is estimated by means of the frequency response measured at the external sound receiver 13 and/or the pressure measured there, when an incoming signal is generated by the noise source 22. The radiation of the source pressure $P_S$ in the ear canal in the case of a free ear canal is estimated by means of the radiation impedance $Z_{RAD}$ and the ear canal impedance $Z_L$.

The individual ear canal impedance $Z_L$, depending on the respective person, is determined by means of the above-mentioned measurements and calculations. However, no individual measurements and/or determinations are possible for the radiation impedance $Z_{RAD}$. Therefore, an estimated value is used, which is based on a theoretical model and measurements with trial subjects, as is described, for example, in the following document:

M. Hiipakka, T. Kinnari and V. Pulkki, "*Estimating head-related transfer functions of human subjects from pressure-velocity measurements*," The Journal of the Acoustical Society of America, 2012.

Thus, the target frequency response and/or the target pressure $P_{T,E}$ at the position of the internal sound receiver 14 in case of a free ear canal are obtained as follows:

$$P_{T,E} = P_S \frac{Z_L}{Z_L + Z_{RAD}}$$

In this exemplary embodiment, the above-described calibration for determining the first correction filter A and the second correction filter B is carried out after each use of the device 10 or earpiece 12 in the ear or the ear canal. Changes on the basis of a deviating position of the device 10 or of the earpiece 12 in the ear canal or on the ear are taken into consideration as a result of this. An acoustic transparency with an especially high quality can be achieved as a result of this. After the calibration or during normal operation of the device 10 or of the earpiece 12, the correction filters A and B remain unchanged according to this exemplary embodiment. As an alternative, an adaptive repositioning and/or recalibration of the correction filter A and/or B can be carried out, especially during the normal operation.

After the calibration, the first correction filter A is used to modify the incoming signal, as a result of which the outgoing signal or the outgoing pressure $P_{E,P}$ is modified. Information about the path of transmission from the position of the internal sound receiver to the eardrum is taken into account by means of the second correction filter B during the modification of the signal incoming to the device 10 or during the generation of the outgoing signal.

Figure 4:
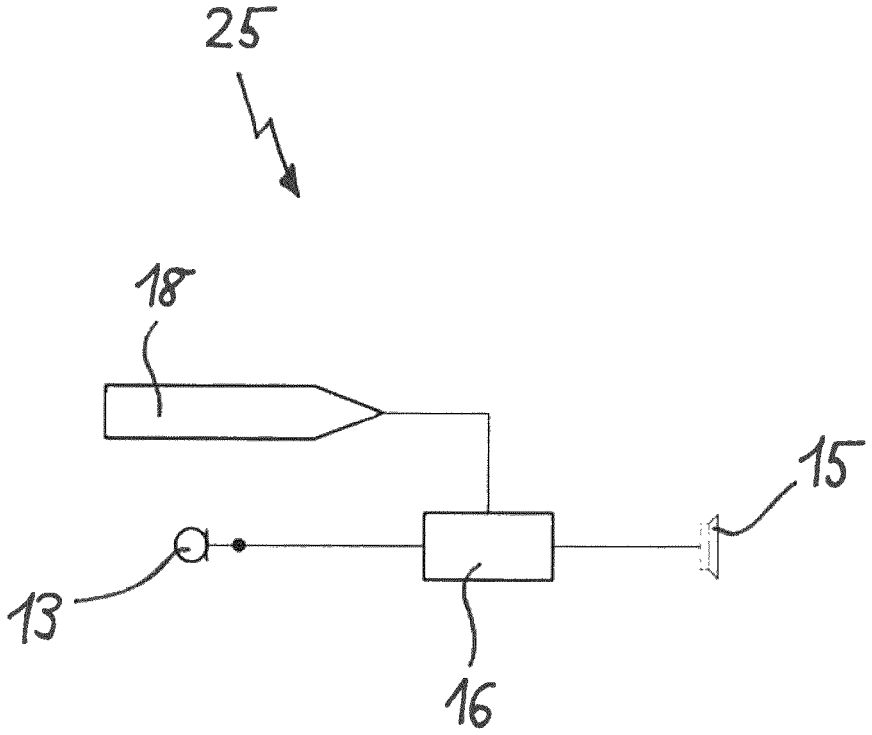
FIG. 4 is a schematic view of a logic circuit of a signal processing device of the electroacoustic device according to FIG. 1.

FIG. 4 shows a schematic view of a logic circuit 25 with a signal processing device 16 of the electroacoustic device 10 according to FIG. 1.

During normal operation an ambient noise is received as an incoming acoustic signal by the external sound receiver 13, converted into an incoming electrical signal and sent to the signal processing device 16. The signal processing device 16 corrects and modifies the signal by means of the two correction filters A and B in order to adapt the frequency response and/or the pressure at the eardrum to the frequency response and/or the pressure at the eardrum in case of a free ear canal. In this exemplary embodiment, the same frequency response and/or the same pressure at the eardrum are generated as in case of a free ear canal because of the two correction filters A and B.

Such an acoustic transparency is made possible, since the incoming signal at the external sound receiver 13 contains all direction information. By contrast, the path of transmission from the inner auricle to the eardrum is independent of the incoming signal direction or sound direction both for the free and the at least partially occluded ear canal.

According to FIG. 1 and FIG. 4 a signal of an additional signal source in addition to the ambient noise, for example, from the noise source 22 according to FIG. 3, is fed to the device 10. For example, the additional signal source 18 is configured as a consumer electronic unit and/or as an additional sound receiver for the device 10. Depending on the purpose and/or type of signal source 18, the additional signal is used to transmit information and/or to amplify the signal incoming to the device 10. The frequency response and/or the pressure at the eardrum on the basis of the additional signal or the additional signal source 18 is modified by means of the correction filters A and/or B determined beforehand in this exemplary embodiment. On the basis of a correction by means of the correction filter B, the additional signal is modified such that undesired transmission effects of the ear canal in an area between an end of the device 10 or of the earpiece 12 facing the eardrum and the eardrum are attenuated and/or avoided.

While specific embodiments of the invention have been shown and described in detail to illustrate the application of the principles of the invention, it will be understood that the invention may be embodied otherwise without departing from such principles.

The invention claimed is:

1. A method for operating an electroacoustic system, the method comprising:

arranging an electroacoustic device for at least partially occluding an ear canal at least partially on an ear;

providing a signal processing device that is configured to process an incoming signal, incoming to the electroacoustic device;

providing the signal processing device with at least one correction unit that is configured to modify the signal incoming to the device, the correction unit comprising a first correction filter of the signal processing device and a second correction filter of the signal processing device, the first correction filter being arranged upstream of the second correction filter;

comparing a total pressure of an external acoustic signal detected within the ear canal at least partially occluded by the electroacoustic device with a target pressure to be expected, to determine the first correction filter;

modifying the incoming signal with the at least one correction unit by means of the first correction filter to provide a modified incoming signal;

modifying the modified incoming signal by means of the second correction filter to filter out transmission effects, in an area from the electroacoustic device to the eardrum on the basis of the at least partial occlusion of the ear canal by means of the electroacoustic device to provide an outgoing signal to achieve acoustic transparency, in which, on the basis of the outgoing signal, a received signal is generated near the eardrum, which is adapted to correspond to a free-ear received signal at the eardrum in the case of a free ear canal without the device.

2. A method in accordance with claim 1, wherein the first correction filter of the signal processing device is configured to achieve the acoustic transparency, the second correction filter of the signal processing device is configured to modify the acoustic signal outgoing from the electroacoustic device, which acoustic signal is based on the outgoing signal, and the acoustic properties of an ear canal section from the device to an eardrum of the ear are taken into consideration by means of the second correction filter.

3. A method in accordance with claim 2, wherein the received signal is generated by means of the acoustic signal outgoing from the device, which acoustic signal outgoing from the device corresponds to the free-ear received signal in case of a free ear canal without the device.

4. A method in accordance with claim 2, wherein to determine the first correction filter of the correction unit, the total pressure is based on a pressure measured by means of an internal sound receiver, which is associated with the device and is facing an eardrum of the ear, is compared with the target pressure to be expected at the internal sound receiver, wherein the target pressure to be expected at the internal sound receiver is estimated to be a pressure at the location of the internal sound receiver in case of a free ear canal without the device.

5. A method in accordance with claim 4, wherein the target pressure to be expected at the internal sound receiver is estimated by means of an electroacoustic model, with a Thevenin pressure source model and/or a source impedance model, and the target pressure to be expected at the internal sound receiver is estimated by means of a source pressure, an ear canal impedance and a radiation impedance, with the following equation:

$$P_{T,E} = P_S \frac{Z_L}{Z_L + Z_{RAD}}.$$

wherein:

$P_{T,E}$ is the target pressure;

$P_S$ is a source pressure;

$Z_I$ is an ear canal impedance; and $Z_{RAD}$ is a radiation impedance.

6. A method in accordance with claim 1, wherein an incoming, acoustic, signal is fed as an incoming electrical signal to the signal processing device by means of an external sound receiver, which is associated with the device and is directed away from the eardrum and outwards, at least one additional external acoustic and/or electrical signal is fed to the signal processing device, by means of an additional external sound receiver and/or a direct wired connection to an additional external signal source, and the additional external signal is preferably modified by means of the correction unit.

7. A method in accordance with claim 1, wherein a calibration is carried out before using the electroacoustic system, the first correction filter and/or the second correction filter is determined within the framework of the calibration, the calibration is carried out after each use of the device for at least partially occluding the ear canal, and the calibration is carried out by means of an external sound source and/or a calibration control unit.

8. A method in accordance with claim 1, wherein the first correction filter of the correction unit is determined on the basis of a first model and/or the second correction filter of the correction unit is determined on the basis of a second model, and the first model and/or the second model is based on the Thevenin equivalent and/or on the Norton equivalent.

9. A method in accordance with claim 1, wherein the total pressure of an external acoustic signal within the ear canal at least partially occluded by the device is composed of two parts to determine the first correction filter of the correction unit, a first part of the total pressure is a passage pressure measured by means of an internal sound receiver, which is associated with the device and is facing an eardrum of the ear, and/or a second part of the total pressure is an outgoing pressure provided by a sound generator, which is associated with the device and is facing the eardrum.

10. A method in accordance with claim 1, wherein the first correction filter is determined with the following equation:

$$A = \frac{P_{T,E} - P_{HT}}{P_{tot} - P_{HT}},$$

taking into consideration a passage pressure measured by means of an internal sound receiver, which is associated with the device and is facing an eardrum of the ear and wherein:

A is the value of the first correction filter;

$P_{T,E}$ is the target pressure;

$P_{tot}$ is the total pressure; and $P_{HT}$ is the passage pressure.

11. A method in accordance with claim 1, wherein after a first determination of the first correction filter of the correction unit, within the framework of a calibration, a fine adjustment of the first correction filter is carried out, at least one predefined calibration signal and/or a predefined noise is used, and a pressure measured by means of an internal sound receiver, which is associated with the device and is facing an eardrum of the ear, is compared with a target pressure during the fine adjustment, wherein the first correction filter is iteratively adapted until a predefined convergence criterion is achieved in case of a deviation of the measured pressure from the target pressure.

12. A method in accordance with claim 1, wherein an estimation of the acoustic received signal at the eardrum is carrier out to determine the second correction filter of the correction unit by means of an internal sound receiver, which is associated with the device and is facing an eardrum of the ear, an identical frequency response and/or an identical pressure at the internal sound receiver and at the eardrum is assumed for the estimation, and the pressure at the eardrum is estimated by means of the pressure which is measured at the internal sound receiver by using an electroacoustic model of the ear canal.

13. A method in accordance with claim 1, wherein a pressure at the eardrum is determined by means of a pressure measured at the internal sound receiver and by means of the correction filter with the following equation:

$$P_D = P_E B,$$

wherein:

$P_D$ is a pressure adjacent to the eardrum;

$P_E$ is a measured at the internal sound receiver; and

B is the correction filter.

14. An electroacoustic system with an electroacoustic device comprising:

an earpiece to at least partially occluding an ear canal of an ear;

an external sound receiver connected to the earpiece and configured to convert an incoming acoustic signal, corresponding to acoustic ambient noises, into an electrical incoming signal;

an internal sound receiver connected to the earpiece so as to be disposed in the ear canal facing an eardrum of the ear and configured to convert ear canal acoustic noises into electrical signals as a received signal;

an output sound generator connected to the earpiece and arranged in an area of the internal sound receiver facing the eardrum and configured to convert an electrical outgoing signal into an outgoing acoustic signal;

a signal processing device configured to process the electrical incoming signal, the signal processing device comprising a correction unit configured to modify the electrical incoming signal, the correction unit comprising a first correction filter of the signal processing device and a second correction filter of the signal processing device, the first correction filter being arranged upstream of the second correction filter, the signal processing device being configured to determine the first correction filter based on a comparison of a total pressure of an external acoustic signal detected within the ear canal at least partially occluded by the earpiece with a target pressure to be expected and to modify the electrical incoming signal with the determined first correction filter to provide a modified incoming signal and to modify the modified incoming signal with the second correction filter to filter out transmission effects, which transmission effects affect acoustic signals in an area from the earpiece to the eardrum on the basis of the at least partial occlusion of the ear canal by means of the electroacoustic device, to provide the electrical outgoing signal to achieve acoustic transparency, in which, on the basis of the outgoing acoustic signal contributing to the ear canal acoustic noises, the received signal is adapted to correspond to a free-ear received signal at the eardrum in the case of a free ear canal without the device.

15. An electroacoustic system in accordance with claim 14, further comprising an additional external sound receiver or an additional external signal source providing an additional external electrical sound signal, wherein:

the incoming acoustic signal is fed as the electrical incoming signal to the signal processing device by means of the external sound receiver and the external sound receiver is mounted on the earpiece to be directed away from the eardrum and outwards;

the additional external electrical sound signal is fed to the signal processing device; and the additional external electrical sound signal is modified by means of the correction unit.

16. An electroacoustic system in accordance with claim 14, wherein:

a calibration of the electroacoustic device is carried out before using the electroacoustic system;

the first correction filter and/or the second correction filter is determined with the calibration;

the calibration is carried out after each use of the device for at least partially occluding the ear canal, and the calibration is carried out by means of an external sound source and/or a calibration control unit.

17. An electroacoustic system in accordance with claim 14, wherein:

the first correction filter of the correction unit is determined on the basis of a first model and/or the second correction filter of the correction unit is determined on the basis of a second model; and the first model and/or the second model is based on the Thevenin equivalent and/or on the Norton equivalent.

18. An electroacoustic system in accordance with claim 14, wherein:

a total pressure of an external acoustic signal within the ear canal at least partially occluded by the device is composed of two parts to determine the first correction filter of the correction unit;

a first part of the total pressure is a passage pressure measured by means of an internal sound receiver, which is associated with the device and is facing an eardrum of the ear, and/or a second part of the total pressure is an outgoing pressure.

19. A method for operating an electroacoustic system, the method comprising:

providing an electroacoustic device comprising an earpiece at least partially occluding an ear canal of an ear, an external sound receiver connected to the earpiece and configured to convert an incoming acoustic signal, corresponding to acoustic ambient noises, into an electrical incoming signal, an internal sound receiver connected to the earpiece to be disposed in the ear canal facing an eardrum of the ear and configured to convert ear canal acoustic noises into electrical signals as a received signal, an output sound generator connected to the earpiece and arranged in an area of the internal sound receiver facing the eardrum and configured to convert an electrical outgoing signal into an outgoing acoustic signal and a signal processing device configured to process the electrical incoming signal;

providing the signal processing device with a correction unit configured to modify the electrical incoming signal and comprising a first correction filter and a second correction filter with the first correction filter arranged upstream of the second correction filter;

with the signal processing device determining the first correction filter based on a comparison of a total pressure of an external acoustic signal detected within the ear canal at least partially occluded by the earpiece with a target pressure to be expected and to modify the electrical incoming signal with the determined first correction filter to provide a modified incoming signal;

with the signal processing device modifying the modified incoming signal with the second correction filter to filter out transmission effects, which transmission effects affect acoustic signals in an area from the earpiece to the eardrum on the basis of the at least partial occlusion of the ear canal by the earpiece, whereby the processing device provides the electrical outgoing signal to achieve acoustic transparency, in which, on the basis of the outgoing acoustic signal contributing to the ear canal acoustic noises, the received signal is adapted to correspond to a free-ear received signal at the eardrum in the case of a free ear canal without the device.

20. A method in accordance with claim 19, wherein:

the total pressure is composed of a passage pressure measured by means of the internal sound receiver, and an outgoing pressure provided by the output sound generator; and the target pressure to be expected at the internal sound receiver is estimated by means of a source pressure, an ear canal impedance and a radiation impedance, with the following equation:

$$P_{T,E} = P_S \frac{Z_L}{Z_L + Z_{RAD}}$$

wherein:

$P_{T,E}$ is the target pressure;

$P_S$ is a source pressure estimated based on a frequency response measured at the external sound receiver and/or a pressure measured at the external sound receiver, when an incoming signal is generated by a noise source;

$Z_L$ is an ear canal impedance; and $Z_{RAD}$ is a radiation impedance.

* * * * *